US007753202B2

(12) United States Patent
Anderson

(10) Patent No.: US 7,753,202 B2
(45) Date of Patent: Jul. 13, 2010

(54) GOLF BAG COVER-COOLER COMBINATION

(76) Inventor: Ty P. Anderson, 208 Golden Maple Dr., Chesapeake, VA (US) 23322

( * ) Notice: Subject to any disclaimer, the term of this patent is extended or adjusted under 35 U.S.C. 154(b) by 254 days.

(21) Appl. No.: 11/629,394

(22) PCT Filed: Apr. 11, 2005

(86) PCT No.: PCT/US2005/012444

§ 371 (c)(1),
(2), (4) Date: Dec. 13, 2006

(87) PCT Pub. No.: WO2006/110146

PCT Pub. Date: Oct. 19, 2006

(65) Prior Publication Data

US 2007/0261976 A1 Nov. 15, 2007

(51) Int. Cl.
*A63B 57/00* (2006.01)

(52) U.S. Cl. ..... 206/315.4; 150/159; 150/901; 62/457.1

(58) Field of Classification Search ..... 150/159, 150/901; 206/315.4; 62/457.1, 457.4, 457.5
See application file for complete search history.

(56) References Cited

U.S. PATENT DOCUMENTS 1,562,030 A * 11/1925 Lawrence ..... 206/315.4
1,795,880 A * 3/1931 Mullins ..... 224/581
2,723,535 A 11/1955 Jones
3,521,689 A * 7/1970 Woods, Jr. ..... 383/4
3,941,398 A * 3/1976 Nelson ..... 280/47.19
D256,293 S * 8/1980 Edwards ..... D3/321
4,343,158 A * 8/1982 Campbell ..... 62/372
4,459,827 A 7/1984 Rhodes
D293,851 S 1/1988 Cannon et al.
4,869,365 A 9/1989 Purdue et al.
4,924,682 A 5/1990 Penner
4,989,767 A 2/1991 Buschbom
4,995,436 A * 2/1991 Cantor ..... 150/102
5,005,623 A * 4/1991 Webster, Jr. ..... 150/159
5,099,898 A * 3/1992 Miller ..... 150/160
5,131,442 A * 7/1992 Bevier ..... 150/159
5,209,280 A * 5/1993 Gevas ..... 150/159
5,301,519 A 4/1994 Howorka
5,409,154 A 4/1995 Blount
5,640,855 A 6/1997 Crescenzo et al.
5,676,247 A * 10/1997 Shioda ..... 206/315.4
5,704,475 A * 1/1998 Jack ..... 206/315.4
5,722,253 A 3/1998 Todd
5,915,551 A 6/1999 Vavro
5,967,324 A * 10/1999 Izzo ..... 206/527
6,067,813 A 5/2000 Smith
6,092,661 A 7/2000 Mogil (Continued)

*Primary Examiner*—Sue A Weaver
(74) *Attorney, Agent, or Firm*—Guerry L. Grune; ePatent Manager

(57) ABSTRACT

The present invention comprises a cover-cooler combination for a golf bag which allows for maintaining perishable items such as beverage or food or both at temperatures above or below room temperature for a sufficient period of time to ensure enjoyment of the item held in the cover-cooler device while also continuing to provide traditional protection for the golf clubs in a golf bag. The cover-cooler combination may also include added features such as wireless device holders, pocket-like holders for keys, writing utensils, golf accessories including additional golf balls and tees, etc. to enhance a golfer's golfing experience by adding convenience.

12 Claims, 3 Drawing Sheets

U.S. PATENT DOCUMENTS 6,148,999 A * 11/2000 Olson ..... 206/315.4
6,237,776 B1 5/2001 Mogil
6,292,438 B1 * 9/2001 Jones ..... 368/10
6,394,325 B1 5/2002 Taylor
6,439,389 B1 * 8/2002 Mogil ..... 206/579
6,513,661 B1 2/2003 Mogil
6,691,866 B1 2/2004 Klock
6,742,354 B1 * 6/2004 Watts ..... 62/457.2
2005/0236080 A1 * 10/2005 Potter ..... 150/159

* cited by examiner

GOLF BAG COVER-COOLER COMBINATION

BACKGROUND OF THE INVENTION

The present invention relates generally to golf bag covers for golf bags that protect both golf clubs and the interior of golf bags from water during inclement weather conditions, the golf club heads during transportation, and more particularly, to a golf bag cover that can be conveniently converted or allowed to act as a cooler for beverage or food. It is also conceivable that the user may think of the device primarily as a cooler that converts into or becomes useful as a golf bag cover.

The conventional cover is provided with snaps for attachment and detachment from the neck of a golf bag and has a zipper for accessing clubs in the golf bag when the cover is used. In a majority of cases, golf is played in weather that is not inclement and the clubs are secured in an upright position on the cart, minimizing the possibility of damage while playing. The golf bag cover is removed from the bag and stored in one of the golf bag compartments providing no additional utility to the golf bag user or worse yet, placed in the golf cart and possibly forgotten at the end of play. Additionally, no matter what their level of skill, most golfers enjoy refreshments on the course during a round of golf. These refreshments include water and soft drinks such as Coke, Pepsi, root beer and the like, as well as alcoholic beverages such as beer. These drinks conventionally are available in twelve (12) or sixteen (16) ounce cans and/or bottles either through dispensing machines placed about the golf course, or at the club facilities including the pro shop, bar or restaurant.

For golfers that take coolers to the golf courses, presently, they must bring a separate cooler with them. At many golf facilities there exist bans regarding bringing conventional hard surfaced coolers into the golf areas. Some coolers are disguised as accessory bags and as such are limited in size and utility.

Thus, a need exists for a golf bag cover that not only protects golf clubs during transport and the interior of the bag from rain or other undesirable weather elements whenever encountered, but also permits for the additional utility as a cooler for beverages and food.

FIELD OF INVENTION

The invention relates to a new and useful product, method and system for golf accessories. Specifically, the invention provides for a product that combines the need for a golf bag cover which protects expensive golf clubs from physical or mechanical damage and has the additional utility that allows for the same product to be used as a cooler. The cover-cooler combination includes several unique features that assist the golfer in maintaining beverage or food or both at temperatures above or below room temperature for a sufficient period of time to ensure enjoyment of the item to enhance a golfer's golfing experience by adding convenience.

DESCRIPTION OF PRIOR ART

Over the years golfers have developed a number of accessory products for use with golf bags as well as coolers with golfing themes, but none refer to combining the items into a single device with multiple uses;

U.S. Pat. No. 2,723,535 to Jones, describes a cooler with a canvas outer layer and an insulative layer that may be strapped to a pull golf cart, golf cart or a golf bag. Its sole purpose is that of a cooler for beverages, food and the like.

U.S. Pat. No. D293,851 to Cannon, et. al., describes an ornamental design of a cooler compartment that is attachable to a golf bag.

U.S. Pat. No. 4,459,827 to Rhodes, describes a golf bag cooler kit for carrying cooled beverages comprising a belt and a mounting plate assembly. The belt straps circle the golf bag and, when tightened, allow for beverages to be placed inside the compartments.

U.S. Pat. No. 4,869,365 to Purdue, et. al., describes an accessory compartment that is detachably secured to the side of a golf bag with a plurality of closable pockets.

U.S. Pat. No. 4,924,682 to Penner, describes a golf bag beverage cooler for attachment to a golf bag with a strap means. It also describes insulation, circular access, a tube and allows for dispensing. A cooling means of freezable fluid provides cooling.

U.S. Pat. No. 4,989,767 to Buschbom, describes a cooler preferably attachable to the front of a golf cart.

Canadian Patent No. CA2225033A to Whenham, describes a cooler specifically designed as a golf accessory that attaches to the side of the golfer's bag. It retains a strap that can be used as a carrying strap to be used independently of the golf bag and a preferred cooling means of ice packs.

U.S. Pat. No. 5,099,989 to Miller, describes a combination golf head cover and beverage container insulator used to cover an individual golf club and receiving a single beverage container. It provides no means for cooling beverages.

U.S. Pat. No. 5,640,855 to Crescenzo, et. al., describes a portable cooler for use with a golf bag wherein the portable cooler is inserted lengthwise into a peripheral side compartment of the golf bag.

U.S. Pat. No. 5,676,247 to Shioda, describes an improved, semi-rigid removable golf bag cover that is removeably attached to a golf bag and is foldable around the perimeter of the golf bag as a means to access golf clubs.

U.S. Pat. No. 5,722,253 to Todd, describes a three part cooler comprising an upper insulated cooler attached to a golf bag and a lower insulated cooler attached to a lower portion of the golf bag both sized to receive a beverage container and a central portion separated from the upper and lower portions to receive a cooling medium.

U.S. Pat. No. 5,915,551 to Vavro, describes a cooler as an integral part of a golf bag located within the bottom portion of a main storage cavity with a means for cooling and an opening in the side for storage and retrieval of beverage cans.

U.S. Pat. No. 6,067,813 to Smith, describes a beverage cooler wherein the beverage is a bottle and the coolant surrounds the bottle sides and the cooler portion is preferably recessed from the bottle mouth.

PCT Publication No. WO 04012826A1 to Klock, describes a cooler for a single bottle attached to a golf bag that is oriented so that the bottle is substantially vertical.

U.S. Pat. No. 6,513,661 to Mogil, describes an insulated, lined, soft shell cooler with a hinged top for inserting and removing beverage containers U.S. Pat. No. 6,092,0661, a continuation of U.S. Pat. No. 6,513,661 to Mogil, describes an insulated, lined, soft shell cooler with a hinged top for inserting and removing beverage containers and a lifting member attached to the lead portion of the cooler and an auxiliary compartment with a closure member operable to gain access.

U.S. Pat. No. 6,237,776, a continuation of U.S. Pat. No. 6,092,0661 to Mogil, describes an insulated, lined, soft-shell cooler with a hinged top for inserting and removing beverage containers.

U.S. Pat. No. 6,394,325 to Taylor, describes a cooler that is removeably attached to a golf cart that is not an accessory to a golf bag.

U.S. Pat. No. 6,439,389, a continuation-in-part of U.S. Pat. No. 6,092,066 to Mogil, describes a flexible insulated cooler with a "C" shaped cylinder extending between the top and bottom wherein the cylinder is moved to allow for accessibility by the user.

Although many of the above referenced patents relate to some form of a golf bag cover, golf club cover, or beverage cooler, none of these inventions teach or even suggest a combination golf bag cover which can be converted into a beverage/foodstuff cooler and container as a unitary device. Presently there are no commercially available combination golf bag cover/beverage coolers that would integrally accompany the golfer on a golf course when they have their bags and clubs. Based on the inventor's experience, it is highly desirable to provide such a combination golf bag cover and cooler.

OBJECTIVE OF THE INVENTION

An objective of the disclosure is to provide a removable golf bag cover-cooler combination for a golf bag having a semi-rigid cover-cooler member that is positionable in an attached condition about a neck of a golf bag so that access to golf clubs and any compartments and accessories defined as part of the golf bag are not hindered. The semi-rigid cover member is removably attached about an area of the neck of the golf bag and is extendable above the neck of the golf bag to an extended position to define a sufficient space to enclose and protect the golf clubs contained in the golf bag. There is an opening of the golf bag cover-cooler combination for accessing the golf clubs in the golf bag when in an extended position and an attachment area is provided for the attached condition about the neck of the golf bag. The attached condition allows for attaching and detaching the golf bag cover-cooler combination to the neck.

The semi-rigid cover-cooler member itself is a compartment that has an opening and is defined by edge boundaries of the semi-rigid cover. The opening may be fully, partially, or not closed at any point in time. The semi-rigid cover member also has a shell wall structure attached to an insulated layer portion and an inner liquid resistant layer portion. The insulated layer and inner liquid resistant portions of the shell wall structure co-operate to also define the compartment which is insulated and liquid resistant and is suitable as a cover-cooler combination for the golf bag.

The golf bag cover-cooler combination is a device that acts simply as a cooler in that the cooler provides thermal insulation for perishable items such as food and beverage.

In another embodiment the semi-rigid cover-cooler member has at least two surfaces.

In another embodiment the golf bag cover-cooler combination has a first surface and second surface of two surfaces including two extending inner edge portions that may extend in an L-shape-like configuration up and over the golf bag. The opening is attached to the inner edge portions for opening of the semi-rigid cover-cooler member, and the second surface may be U-shaped-like and extend above the golf bag to join with the first surface thereby defining a sufficient space above the golf bag to enclose and protect the golf clubs contained in the golf bag and provide the compartment which is insulated and is suitable as the cover-cooler combination for the golf bag.

Another embodiment provides for a golf bag cover-cooler that is positionable in an attached, non-collapsed or collapsed condition about the neck of the golf bag in a convenient, out-of-the-way disposition so that access to the golf clubs in and pockets on said golf bag are not hindered. The opening of the cover-cooler member for accessing the golf clubs in the golf bag when in an extended position above the golf bag, includes at least one predetermined fold-line for predetermined and controlled folding of the cover-cooler member from its extended position to a collapsed position about the attachment area of the neck of the golf bag when the opening is open. There is an attachment arrangement attached to the cover-cooler member for securing the cover-cooler member in a non-collapsed or collapsed position about the neck of the golf bag so that the cover-cooler member does not obstruct access to golf clubs in or pockets on the golf bag. There is provided a securing member extending across or around the opening of the cover-cooler member defined by the opening when the opening is open. The opening may be closed by use of tie-strings, elastic bands, or a flap-like assembly to provide enclosure for the compartment which is insulated and is suitable as a cover-cooler combination for the golf bag.

In another embodiment, the golf bag cover-cooler combination has at least two surfaces and at least one predetermined fold-line having multiple fold-lines.

An additional embodiment is to provide the golf bag cover-cooler combination with an attachment arrangement extending across or around the opening when the opening is open or closed and includes an attachment arrangement with either a strap or handle or any convenient combination.

In another embodiment the cover-cooler combination in an attachment arrangement has fastening components composed of hook and loop Velcro® or Velcro®-like material, zippers, straps, elastic bands or snaps.

In yet another embodiment the cover-cooler combination attachment arrangement includes one or more slits that function as a handle.

An additional embodiment of the golf bag cover-cooler combination is provided where the attachment arrangement has two or more hook and loop material strips with one or more functions—described as a tandem function—such that one function ensures proper attachment of the attachment arrangement to the golf bag or to a golf cart, and the other function provides for proper closure of the cover-cooler combination opening.

In another embodiment, the Velcro® strips may be used for a tandem function in that the strips include hook and loop features on opposing surfaces where the strips have adhesive backing and where the strips may include a peelable adhesive backing which is placed in coordination with an exterior surface rim of the golf bag and an interior surface of the cover-cooler combination. This allows for mating of the hook and loop features of the strips for attaching the golf bag or golf cart to the cover-cooler combination or to provide for proper closure of said cover-cooler combination. In fact or provide both functions. In another objective the attachment arrangement has straps having complementary detachable fastening components.

In another embodiment the attachment arrangement includes at least two straps.

In yet another embodiment the golf bag cover-cooler combination includes a see-through pocket mounted externally for any compartments for accessories defined as part of the golf bag cover-cooler combination.

Another embodiment is to have a transparent pocket mounted to one of the side portions of the cover-cooler combination.

Another embodiment includes a golf bag cover-cooler combination having a flexible, semi-rigid shell wall structure having a flexible insulated layer, a bottom portion, a top portion, and a sidewall structure, where the sidewall structure has a leading portion, a trailing portion and left and right side portions. The leading, trailing, left and right side portions of the sidewall structure extend between the top and bottom portions where the portions of the semi-rigid shell wall structure co-operate to define an insulated compartment. The sidewall structure leading, trailing and left and right side portions have upper edge boundaries where the upper edge boundaries co-operate to define an opening of the insulated compartment, wherein the top portion is a lid or flap, said lid or flap being moveable to an open position to expose the opening of the insulated compartment, where the sidewall structure also has a rim extending about the opening. There is also a liner mounted to the rim, and positionable within the compartment and moveable to an inverted position to facilitate washing and which is also thermally insulated and liquid resistant. A lifting member is attached to the leading portion of the flexible soft shell wall structure. The lifting member is a strap or handle or at least one slit or any convenient combination. The sidewall structure has a height, a depth, and a breadth, with the height being greater than either the depth or the breadth and a secondary wall structure mounted to the trailing portion of the semi-rigid shell wall structure to define an auxiliary compartment. The secondary wall structure has an auxiliary compartment closure member operable to give access to the auxiliary compartment.

Another embodiment includes a lid or flap that is moveable to a closed position relative to the insulated compartment, where the lid or flap has an inside surface having a peripheral bead formed around the inside surface that faces toward the insulated compartment when the lid or flap is in a closed position and the rim has an upwardly extending bead standing in opposition to the bead of the lid or flap when the lid or flap is in a closed position.

Another embodiment includes an auxiliary compartment that has a holder mounted inside the compartment wherein the holder provides for keys, wireless devices, or other personal devices that have utility for an individual or group of golfers.

In yet another embodiment the holder includes a lanyard secured within the auxiliary compartment.

Another embodiment shows one of the side portions having see-through side pocket(s), with the pocket(s) having a leading edge, a trailing edge and an opening between the leading and trailing edges. The leading edge is longer than the trailing edge and the auxiliary compartment has see-through vented pocket(s) mounted externally thereto and the lid or flap has a carrying member attached to it.

Another embodiment provides compartment(s) pocket(s) formed of the flexible, liquid resistant material.

Another embodiment provides for the lifting member that includes a strap with a quick release hanging mechanism for attachment to the cover-cooler combination.

Another embodiment provides for a girth reinforcement that may be added extending about the sidewall structure adjacent to the bottom portion and the top portion of the cover-cooler combination.

In yet another embodiment, the liner is impermeable and is attached continuously around the rim.

In yet another embodiment, the insulated compartment has a thermal transfer medium holder mounted inside and the holder is vented.

In yet another embodiment a reusable ice or heating substitute exists in the top portion of the cover-cooler, such that when the cover-cooler is inverted and closed or sealed, the ice or heating substitute is activated by placing the cover-cooler in a freezer or oven for a period of time.

In another embodiment the cover-cooler contains a chemical warmer sized for storage in an average freezer or oven.

In another embodiment, the method for using an openable and collapsible golf bag cover-cooler combination includes the steps of:

attaching a semi-rigid cover-cooler member to an area of a neck of a golf bag;

opening the cover-cooler member when in an extended position above the golf bag enclosing and protecting golf clubs contained in the golf bag;

folding the cover-cooler member down about an attachment area of the neck of the golf bag about at least one predetermined fold-line in the cover-cooler member;

detaching a collapsed cover-cooler member from the neck of the golf bag with a holding device such as straps or hook and loop material strips attached to the cover-cooler member so that the cover-cooler member does not obstruct access to golf clubs in pockets on the golf bag;

opening or closing an opened section of said cover-cooler member to insert or remove objects that require thermal insulation over a period of time;

and inserting or removing objects when desired.

In another embodiment there is a system for using a removable golf bag cover-cooler combination for a golf bag having a semi-rigid cover-cooler member that is positionable in an attached condition about the neck of the golf bag so that access to golf clubs and any compartments and accessories defined as part of the golf bag are not hindered. The semi-rigid cover member is removably attached about an area of the neck of the golf bag and is extendable above the neck of the golf bag to an extended position to define a sufficient space to enclose and protect the golf clubs contained in the golf bag. There is an opening in the golf bag cover-cooler combination for accessing the golf clubs in the golf bag when in an extended position where an attachment area is provided for an attached condition about the neck of the golf bag. The attached condition allows for attaching and detaching the golf bag cover-cooler combination to the neck. The semi-rigid cover-cooler member itself has an opening to a compartment within and defined by edge boundaries of the semi-rigid cover. The opening may be optionally fully, partially, or not, closed at any point in time and the semi-rigid cover member also optionally comprises a shell wall structure attached to an insulated layer portion and an optional inner liquid resistant layer portion. The insulated layer and inner liquid resistant portions of the shell wall structure co-operate to also define the compartment which is optionally insulated and liquid resistant and is suitable as the cover-cooler combination for the golf bag. Using the openable and collapsible golf bag cover-cooler combination has the steps of: attaching a semi-rigid cover-cooler member to an area of a neck of a golf bag; opening the cover-cooler member when in an extended position above the golf bag enclosing and protecting golf clubs contained in the golf bag; folding the cover-cooler member down about an attachment area of the neck of the golf bag about at least one predetermined fold-line in the cover-cooler member; detaching the cover-cooler member from the neck of the golf bag with a holding member such as straps or Velcro®-like strips for attachment of the cover-cooler member so that the cover-cooler member does not obstruct access to golf clubs in or pockets on the golf bag; opening or closing an opened section of the cover-cooler member to insert or remove objects that require thermal insulation over a period of time and inserting or removing the objects when desired.

In another embodiment the cover-cooler combination is a device that acts simply as a cooler in that the cooler provides thermal insulation for perishable items such as food and beverage.

Another embodiment includes the semi-rigid cover-cooler member having at least two surfaces.

Another embodiment is where a first surface of the two surfaces includes two extending inner edge portions that may extend in an L-shape-like configuration up and over the golf bag with the opening being attached to the inner edge portions for opening of the semi-rigid cover-cooler member and the second surface may be U-shaped-like and extend above the golf bag to join with the first surface defining a sufficient space above the golf bag to enclose and protect the golf clubs contained in the golf bag and provide a compartment which is insulated and is suitable as the cover-cooler combination.

Another embodiment is where the cover-cooler combination is positionable in an attached, non-collapsed or collapsed condition about a neck of a golf bag in a convenient, out-of-the-way disposition so that access to golf clubs in and pockets on the golf bag are not hindered having an opening of the cover-cooler member for accessing the golf clubs in the golf bag when in the extended position above the golf bag. The cover-cooler member includes at least one predetermined fold-line for predetermined and controlled folding of the cover-cooler member from its extended position to a collapsed position about the attachment area of the neck of the golf bag when the opening is open. A securing member is attached to the cover-cooler member for securing the cover member in the collapsed or non-collapsed position about the neck of the golf bag so that the cover-cooler member does not obstruct access to golf clubs in or pockets on the golf bag. The securing member extends across or around the opening in the cover-cooler member defined by the opening member when the opening is open. The opening may be closed by use of tie-strings or a flap-like assembly to provide enclosure for the compartment which is insulated and is suitable as the cover-cooler combination for the golf bag.

In another embodiment, the cover-cooler combination has two surfaces and at least one predetermined fold-line and optionally has multiple fold-lines.

In another embodiment, the securing member extends across or around the opening member when the opening member is open or closed and the securing member may include either a strap or handle or at least one slit or any convenient combination.

In another embodiment, the securing member has straps having complementary detachable fastening components.

In another embodiment, the securing member includes at least two straps.

In another embodiment, the securing member has fastening components composed of Velcro® or Velcro-like material.

In another embodiment, the cover-cooler combination includes a see-through pocket mounted externally for any compartments or accessories or mounted to one of the side portions of the cover-cooler combination.

In another embodiment includes the step of detaching the collapsed cover-cooler member which includes extending the holding member across an opening formed when the cooler-cover member is opened and fastening detachable engagement complimentary fastening components that are secured to the ends of the holding member of straps or handles or at least one slit or any convenient combination to assure a useful holding member is accomplished.

In another embodiment the attachment arrangement includes on or more slits that make up the handle.

In another embodiment the attachment arrangement has two or more Velcro® strips with one or more functions known as a tandem function. One function is to ensure proper attachment of the attachment arrangement to the golf bag or to a golf cart and another function is to provide for proper closure of the cover-cooler combination opening.

In another embodiment, the Velcro® strips may be used as a tandem function in that the strips include hook and loop features on opposing surfaces and the strips also have adhesive backing. The adhesive backing may be peelable such that the adhesive backing may be placed in coordination with an exterior surface rim of the golf bag and an interior surface of the cover-cooler combination such that mating of the hook and loop features of the strips may occur either to attach the golf bag or golf cart to the cover-cooler combination or to provide for proper closure of the cover-cooler combination or provide both functions.

In another embodiment, the optionally removable universal golf bag cover-cooler combination for a golf bag has-a semi-rigid cover-cooler member that is positionable in an attached condition about the neck of a golf bag so that access to golf clubs and any compartments and accessories defined as part of the golf bag are not hindered. The semi-rigid cover member is removably attached about an area of the neck of the golf bag and is extendable above the neck of the golf bag to an extended position to define a sufficient space to enclose and protect the golf clubs contained in the golf bag. The opening of the golf bag cover-cooler combination is for accessing the golf clubs when in an extended position and an attachment area is provided for the attached condition about the neck of the golf bag. The attached condition allows for attaching and detaching the golf bag cover-cooler combination to the neck. The semi-rigid cover-cooler member itself has a compartment that has an opening and is defined by edge boundaries of the semi-rigid cover where the opening may be optionally fully, partially, or not closed at any point in time, and has a shell wall structure attached to an optionally insulated layer portion and an optional inner liquid resistant layer portion. The insulated layer and inner liquid resistant portions of the shell wall structure co-operate to also define the compartment that is optionally insulated and liquid resistant and is suitable as the cover-cooler combination for any golf bag or golf cart.

In another embodiment, the cover-cooler combination is specifically suitable for customized golf bags or golf carts and has been designed specifically for the customized golf bags or golf carts.

In another embodiment the cover-cooler combination includes an insulated compartment defined by the semi-rigid shell wall structure that may be opened, exposed, and moved inwardly outward to make the process of washing easier.

SUMMARY OF INVENTION

The present invention comprises a cover-cooler combination for a golf bag which allows for maintaining beverage or food or both at temperatures above or below room temperature for a sufficient period of time to ensure enjoyment of the item that is held in the cover-cooler device, while also continuing to provide traditional protection for the golf clubs in a golf bag. The thermal insulation provided within the cover-cooler combination will also ensure against items (that must maintain a low or high temperature) from perishing or degrading to a point where the items may become unusable (or at the very least undesirable).

Thus, one object of the present invention is to provide a golf bag cover-cooler combination that is primarily a unitary device in that the combination is preferably one-piece, however, this is not a prerequisite for the device. The cover-cooler combination may also be multi-sectioned. The cover should be comprised of an outer layer of durable, semi-rigid material, such as canvas comprised of traditional woven or even non-woven materials including thermoplastics and the like, with and without cellular or foamed structure and including various material composites as so desired. The cover-cooler combination must also continue to protect the golf bag and the golf bag's contents from rain or transportation damage and also must cover and protect a preferred second layer comprised of insulative material and an optional but highly desirable either separate or combined layer utilizing waterproof or at least water resistant material.

Another object of the present invention is to include in the combination cover-cooler a feature for opening and closing to aid in accessing golf clubs and for removal of the golf bag cover from the golf bag. An additional feature provides the dual utility of closing an opened portion of the cover-cooler combination, once removed from the golf bag, to aid in keeping the contents, such as beverages and foodstuffs thermally insulated as well as providing a convenient carrying means.

It is therefore an additional object of the present invention to provide a combination golf bag cover and cooler that is insulated and operationally efficient for storing beverage and food, as well as protecting golf clubs from mechanical, physical or meteorological damage.

The cover-cooler combination may also include added features such as wireless device holders, pocket-like holders for keys, writing utensils, golf accessories including additional golf balls and tees, etc. These additional features and their utility are essentially infinite and therefore it should suffice to state that the present invention may include all known and foreseen features that could be added to the cover-cooler combination to enhance a golfer's golfing experience by adding convenience.

DETAILED DESCRIPTION OF THE DRAWINGS

Figure 1:
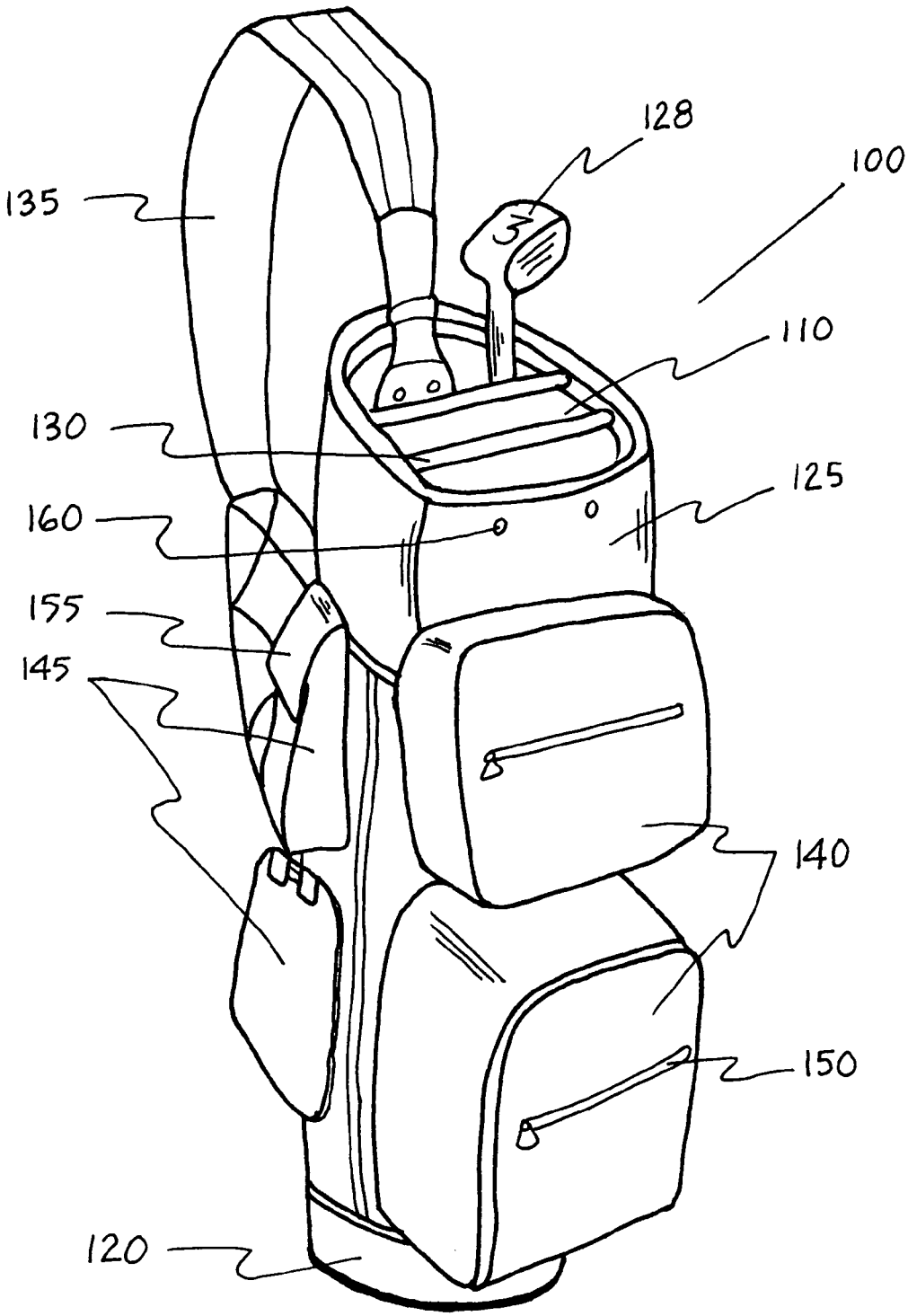
FIG. 1 is an illustration of a typical golf bag for storing golf clubs.

The description which follows, and the embodiments described therein, is provided by way of illustration of an example, or examples of particular embodiments of the principles of the present invention. These examples are provided for the purposes of explanation, and not of limitation, of those principles and of the invention. In the description which follows, the same parts are marked throughout the specification and the drawings with the same respective reference numerals. The figures represent the cover-cooler combination and are not drawn to scale and in some instances proportions have been exaggerated in order to more clearly depict certain features of the invention.

FIG. 1 illustrates a typical golf bag [100], which is comprised of a club storage cavity [110], which is essentially vertical, with a base [120] typically of a rigid, wear resistant construction. The uppermost portion of the club storage cavity [110] is the neck [125], which may contain horizontal club separators [130] for separating a plurality of golf clubs [128]. Typically attached to the base [120] and the neck [125] is a strap [135] used to carry the golf bag [100]. Other features such as compartments [140] and accessories [145] may be removeably attached to the outer surface of the club cavity [110]. Compartments [140] and accessories [145] may contain fasteners such as zippers [150], or hook loop(s) [155], manufactured from materials such as Velcro®, or the fasteners may be snaps [160].

Figure 2:
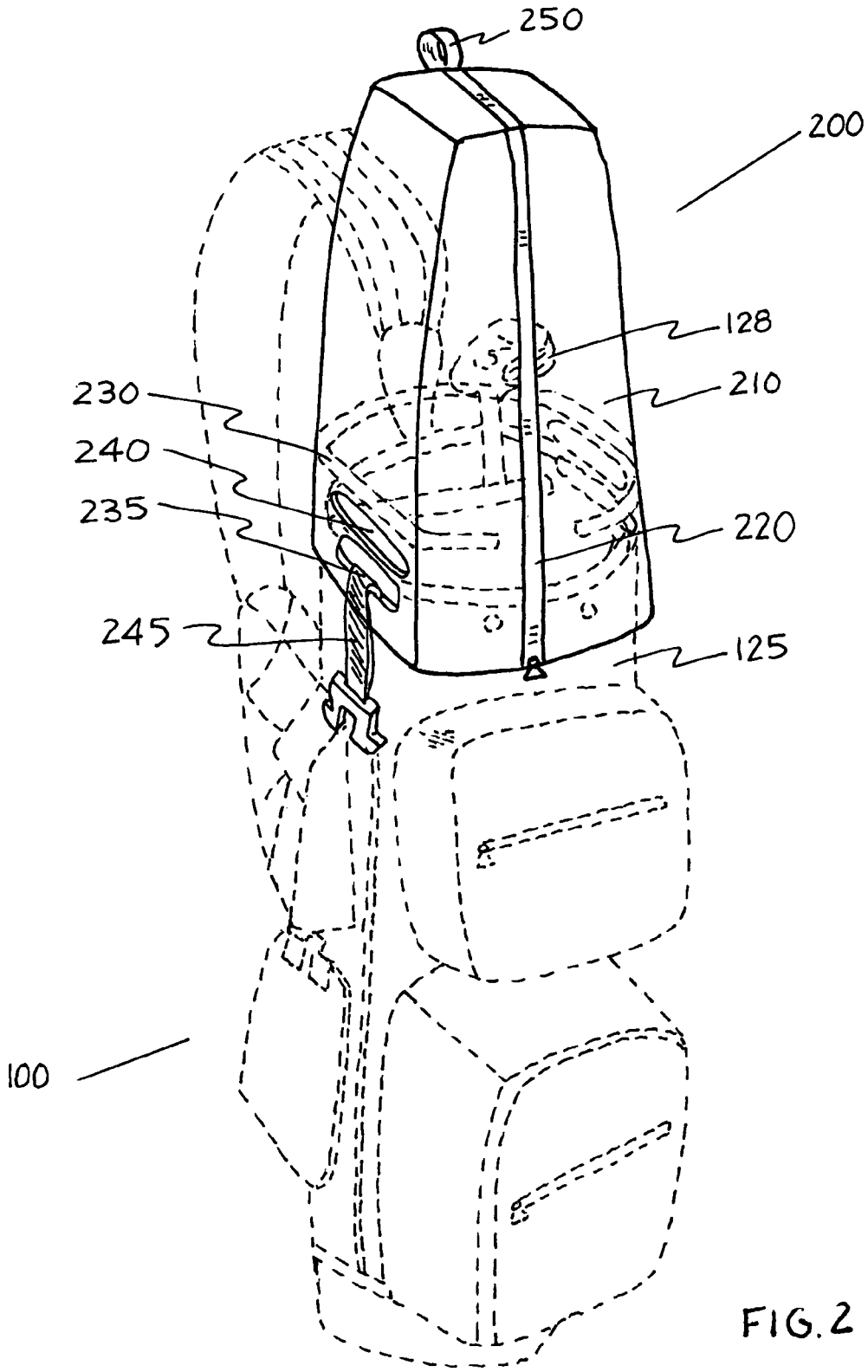
FIG. 2 is an illustration of a golf bag cover and how it fits with relation to a typical golf bag.

FIG. 2 is a golf bag cover-cooler combination [200] large enough to peripherally cover a neck [125] of a golf bag [100] with golf clubs [128] in the club storage cavity [110] comprising a semi-rigid material [210] preferably with a waterproof zipper [220] to open and close the cover-cooler combination [200] for access to golf clubs [128]. When closed, the zipper [220] ensures that the cover-cooler combination becomes a closed barrier to rain and other undesirable weather related elements. An optional elastic band [230] is attached, preferably sewn into place, peripherally around the golf bag cover-cooler combination [200]. Closure/fasteners such as Velcro® [235] are preferably sewn in place to enable closure of the golf bag cover-cooler combination [200] when it is removed and inverted for use as a cooler (FIG. 3) [300] for beverages or food. The closure/fasteners made of Velcro® may also be used to secure the golf bag cover-cooler combination [200] to the neck [125] of the golf bag [100]. The cover-cooler [200] combination may be preferably portably transported by the user inserting their fingers and grasping the appropriate section of the cover-cooler combination through an opening [240] or optionally by means of an accessory handle removeably attached to the cover-cooler combination [200]. The accessory handle [245] may also be used to secure the cover-cooler combination [200] optionally to the outside of a golf bag [100] again by use of hook and loop features associated with Velcro® and the like.

Additionally the cover-cooler combination [200] may contain fasteners such as zippers [150], hook loop(s) [155], using Velcro® as the material of choice, or possibly snaps [160] to secure the cover-cooler combination [200] to the golf bag [100]. A method for attaching the cover-cooler combination to a golf cart in the same fashion as would be used to attach to a golf bag is also possible, as is just allowing for carrying the cover-cooler separately. The primary purpose of providing the features described above for fastening the cover-cooler to the golf bag (or golf cart) is to ensure that the cover-cooler combination is universal, in that it would fit essentially any manufactured golf bag or golf cart or accessories thereof. It is possible and also within the scope of the intent of this specification, that the cover-cooler combination be manufactured to specifications required for custom golfbags and/or golf carts. These custom designs will vary in terms of the attachment requirements necessary to ensure proper linkage with the cover-cooler combination.

The cover-cooler combination [200] may also contain a loop feature [250] to allow for hanging the cover-cooler combination [200] to aid in drying, cleaning or providing other user's needs.

Figures 3A, 3B:
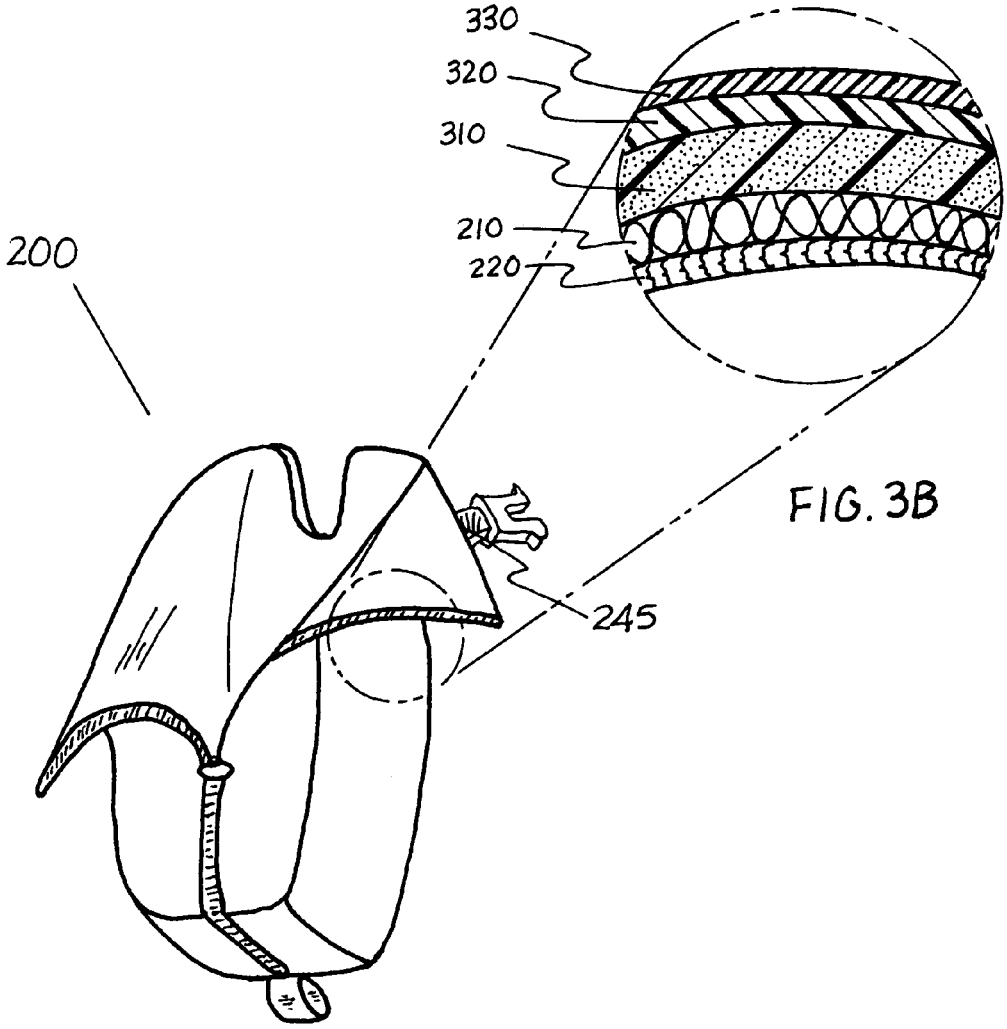
FIG. 3A is an illustration of only a golf bag cover inverted in the cooler position.
FIG. 3B is an illustration of the basic construction materials of the cover-cooler.

FIG. 3A illustrates the cover-cooler combination [200] in an inverted position, preferable for use as a cooler indicating material for the cover-cooler combination [200] in FIG. 3B which is comprised of a semi-rigid outer surface [210], preferably of waterproof material such as a canvas or webbed material, a preferable but optional inner layer of insulative material [310], preferably of a closed cell foamed polymer and an inner layer [320] of another waterproof material which may or may not be identical to that of the outer surface [210] material. An optional waterproof liner [330] such as a plastic sack, may be inserted into the cover-cooler [200] based upon the user(s)' preference. The zipper [220] is secured through the material layers [210,310,320] by stitching or other means to bind the material layers [210,310,320] together. When the zipper [220] is closed, and the cover-cooler [200] is inverted, the cover-cooler [200] is considered to be an essentially watertight compartment. The cover-cooler [200] inner layer [320] with the zipper [220] fully released may be inverted inwardly outward for ease in cleaning or drying of the inner layer [320]. There is also a possibility of using a strap [245] for use as a handle so that the cooler may be carried appropriately.

Additional features (not shown) may include compartments for electronic devices, personal belongings, and the like, and may provide for openings sidewardly opened or opened from either a topside or a bottom side depending on whether the cover-cooler [200] is vertical as shown in FIG. 2 or the cover-cooler [200] is inverted as in FIG. 3. Compartments for containing chemical 'ice packs' or 'warmers' may be added to the inner layer [320] to aid in cooling or heating as desired. The cover-cooler combination [200] may optionally be adapted to different manufacturers golf bag [100] specifications for size, shape, color, and design, as required.

It will, of course, be appreciated that the embodiments described have been given simply by the way of illustration, and the invention is not limited to the precise embodiments described herein. Various changes and modifications of the embodiments disclosed may be prepared by one skilled in the art without departing from the scope or spirit of the invention and as defined in the appended claims.

What is claimed is:

1. A removable golf bag cover-cooler combination for a golf bag comprising;

a semi-rigid flexible cover-cooler that is attached to a neck of said golf bag providing an attachable position allowing a means for accessing golf clubs wherein said cover-cooler is positioned to ensure that any compartments and accessories defined as part of said golf bag are not hindered by said cover-cooler and wherein said cover-cooler is removably attached from said neck of said golf bag and is extendable above said neck of said golf bag to an extended position defining a sufficient space to enclose and protect said golf clubs contained in said golf bag;

an opening of said cover-cooler for accessing said golf clubs in said golf bag when in said extended position, whereby an attachment area is provided for attaching said neck of said golf bag allowing for attaching and detaching said cover-cooler to said neck;

and wherein said cover-cooler in an inverted position comprises an insulated compartment that has an opening defined by edge boundaries of said cover-cooler wherein said opening is fully, partially, or not closed at any point in time, and wherein said cover-cooler also comprises an outer surface attached to an inner layer wherein said inner layer provides closed cell foamed polymer insulation and is essentially watertight such that said inner layer and said outer surface co-operate to also define said compartment, and wherein said compartment remains suitable as a portion of said golf bag cover-cooler combination and wherein said cover-cooler includes a waterproof zipper as a means for opening and closing said cover-cooler in said inverted position such that said zipper secures material layers held, together with stitching or other means and said cover-cooler comprises an outer surface of canvas or webbed waterproof material and an inner layer of either the same or different waterproof material wherein when said zipper is closed and said cover-cooler is inverted, said cover-cooler in combination with said compartment provide an essentially watertight cover-cooler and wherein said inner layer utilizing said zipper in a fully released position places said cover-cooler in combination with said compartment such that said inner layer is fully exposed as if it were an outer layer allowing for ease in cleaning or drying said inner layer.

2. The golf bag, cover-cooler combination according to claim 1, wherein said cover-cooler combination is a device that acts simply as a cooler in that said inner layer provides thermal insulation for perishable items such as food and beverage.

3. The golf bag cover-cooler combination according to claim 1, wherein said cover-cooler includes extending said outer surface and said inner layer up and over said golf bag, thereby defining a sufficient space above said golf bag to enclose and protect said golf clubs contained in said golf bag and provide said compartment for said golf bag.

4. The golf bag cover-cooler combination according to claim 1, wherein said cover-cooler combination is in said attachable position around the neck of said golf bag so that access to said golf clubs in and pockets on said golf bag are not hindered, comprising said closable opening in said cover-cooler for accessing said golf clubs when in said extended position above said golf bag, and wherein said opening may be closed providing an enclosure for said compartment in an inverted position which is insulated and is suitable as said cover-cooler combination.

5. The golf bag cover-cooler combination according to claim 1, wherein said cover-cooler combination in said attachable position comprises fastening components composed of hook and loop fastener material, zippers, straps, elastic bands or snaps.

6. The golf bag cover-cooler combination according, to claim 1, wherein said cover-cooler combination in an inverted position includes a handle.

7. The golf bag cover-cooler combination of claim 6, wherein said handle includes a strap with a quick release hanging mechanism for attachment to said cover-cooler combination.

8. The golf bag cover-cooler combination according to claim 1, wherein said attachable position comprises two or more hook and loop fastener strips wherein one function is to ensure proper attachment of said attachable position to said golf bag and another function within said cover-cooler combination in an inverted position is to provide for proper closure of said opening of said compartment.

9. The golf bag cover-cooler combination according to claim 8, wherein said hook and loop fastener is placed in coordination with said neck of said golf bag and an interior surface of said cover-cooler combination such that mating of hook and loop features of said hook and loop fastener strips allows for attaching said golf bag to said cover-cooler combination.

10. The golf bag cover-cooler combination of claim 1, wherein said cover-cooler combination includes compartments for accessories defined as part of said golf bag cover-cooler combination.

11. The golf hag cover-cooler of claim 1, wherein said cover-cooler uses a reusable ice or heating substitute in said cover-cooler, such that when said cover-cooler is inverted and closed, said ice or heating substitute is activated.

12. The golf bag cover-cooler of claim 1, wherein said cover-cooler is sized for storage in an average, freezer or oven.

* * * * *